US007159850B2

(12) United States Patent
Peters

(10) Patent No.: US 7,159,850 B2
(45) Date of Patent: Jan. 9, 2007

(54) PNEUMATIC CARPET STRETCHER

(76) Inventor: Lee Peters, #302-230 Dogwood Crescent N., 100 Mile House, British Columbia (CA) V0K 2E0

( * ) Notice: Subject to any disclaimer, the term of this patent is extended or adjusted under 35 U.S.C. 154(b) by 0 days.

(21) Appl. No.: 11/169,640

(22) Filed: Jun. 30, 2005

(65) Prior Publication Data

US 2006/0001014 A1 Jan. 5, 2006

Related U.S. Application Data

(60) Provisional application No. 60/585,794, filed on Jul. 2, 2004.

(51) Int. Cl.
*B65H 77/00* (2006.01)

(52) U.S. Cl. ..... 254/201

(58) Field of Classification Search ..... 254/199, 254/200, 201, 210, 212
See application file for complete search history.

(56) References Cited

U.S. PATENT DOCUMENTS

| | | | | |
|---|---|---|---|---|
| 4,042,211 | A | 8/1977 | Hammond et al. | |
| 4,084,787 | A | 4/1978 | Kowalczyk | |
| 5,145,225 | A * | 9/1992 | Muller et al. | 294/8.6 |
| 6,371,446 | B1 * | 4/2002 | Gauthier et al. | 254/201 |
| 6,994,323 | B1 * | 2/2006 | Carbajal | 254/212 |

* cited by examiner

*Primary Examiner*—Kathy Matecki
*Assistant Examiner*—Evan Langdon
(74) *Attorney, Agent, or Firm*—Antony C. Edwards

(57) ABSTRACT

A pneumatic carpet stretcher includes a pneumatic actuator, a piston rod actuated by the pneumatic actuator driving a carpet gripping stretcher head towards an anchor pivotally mounted on a frame to the actuator and releasably mounted behind a tack strip on a floor to be carpeted so that the head and carpet is driven towards the anchor.

20 Claims, 9 Drawing Sheets

PNEUMATIC CARPET STRETCHER

CROSS REFERENCE TO RELATED APPLICATION

This application claims priority from U.S. Provisional Patent Application No. 60/585,794 filed Jul. 2, 2004 entitled Pneumatic Semi-Automatic Carpet Stretcher.

FIELD OF THE INVENTION

This invention relates to a pneumatically actuated, semi-automatic carpet stretcher used to reduce wrinkles and creases in a carpet during installation.

BACKGROUND OF THE INVENTION

In the installation of conventional wall to wall carpeting, it is the usual practice to anchor tackless carpet strips about the periphery of the room and then to affix the carpet in place over the floor by anchoring the peripheral edges of the carpet to the tackless strips. In order to produce a satisfactory installation of the carpet without ripples, creases, looseness or other defects in installation, it is the usual practice to employ suitable tools to stretch the carpet sufficiently prior to permanently engaging the peripheral edges of the carpet to the tackless strips.

The tools conventionally employed for carpet stretching purposes are manually operated and generally comprise three distinct types of tools, namely, a knee kicker, a pole stretcher type or an anchor blade type of device.

The knee kicker is a relatively small tool which comprises generally a carpet gripper head and a padded body suitable for receiving impacts from the knee of the installer to push the carpet gripper head forwardly to thereby stretch the carpet. Such devices are relatively easy to operate by a single workman, but are limited in operation and in function by their inability to develop suitable power to stretch the carpet, especially where large rooms are involved.

The pole stretcher type of installation tool comprises a carpet gripper head and an elongated pole which extends from one sidewall of the room to enable the tool to push against the sidewall as the carpet is stretched toward the opposite sidewall. Usually a manual handle functions a lever mechanism to push the carpet gripper head towards the tackless strip for carpet stretching purposes. This tool also required considerable strength and the use of both hands of the operator. Further, regulation of the length of stretch is fixed by the design of the lever mechanism and this cannot be adjusted by the operator.

The anchor blade type of installation tool comprises essentially a carpet gripper head and an anchor blade for positioning behind the tackless strip. Usually an elongated operating handle is employed to function through a leverage principle to pull the carpet gripper head toward the anchoring blade to thereby stretch the carpet in the path of travel. Such devices develop sufficient power to adequately pull and stretch the carpet but require considerable strength and the use of both hands of the operator.

As described by Muller et al. in U.S. Pat. No. 5,145,225, carpet manufacturers recommend that jute-backed tufted carpets be stretched "drum-tight". The amount of stretch needed for a polypropylene backed carpet is usually calculated as one and a half percent of the carpet length and width. The amount of stretching required is further complicated for jute-backed carpeting of lengths longer than 7 meters because the carpet tends to drag against the underlay and make the stretch "feel" tighter than it really is. In addition the amount of stretch required for a particular type of carpet varies between carpets produced by different manufacturers.

As a consequence a carpet installer is usually a highly experienced well practiced individual who is capable of making a qualitative judgement whether or not he has stretched a carpet properly. If the judgement is incorrect the carpet usually requires restretching. If the carpet is over-stretched and begins to contract after settling the carpet in question might have to be replaced at the expense of the carpet installer.

Inclusive of the teaching of Muller et al. it is also known in the prior art to use hydraulic, electric and pneumatically actuated carpet stretchers. For example, applicant is aware of U.S. Pat. No. 4,042,211 which issued Aug. 16, 1977 to Hammond et al. for a Portable Device for Stretching and Installing Carpet. The Hammond device is taught to include a cylinder carried by a handle, the handle member having a spring biased piston, a piston rod connected to the piston extending through one end of the cylinder and having a leg member depending from the piston rod for engaging the carpet to be installed. A support member is disclosed which depends from one end of the handle member for mounting behind a floor mounted wood strip to which the carpet is to be attached. The piston is moved so as to stretch the carpet engaged by the leg member toward the support member so that the carpet may be attached to the floor mounted wood strip.

U.S. Pat. No. 4,084,787 issued Apr. 18, 1978 to Kowalczyk for a Carpet Installation Tool which includes a portable body having an anchoring blade to engage behind a tackless carpet strip, the body having a carpet gripper head including pins for engaging the carpet and stretching the carpet upon a motor moving the carpet gripper ahead relative to the anchoring blade so as to stretch the carpet engaged by the pins.

As noted above, U.S. Pat. No. 5,145,225 issued Sep. 8, 1992 to Muller et al. for a Carpet Stretcher. The carpet stretcher of Muller includes a retractable carpet engaging head which is pneumatically driven by a cylinder. The cylinder is mounted to a frame. The frame supports a face plate extension adapted for location behind a tackless strip so that the carpet stretcher may stretch carpet towards an adjacent wall to engage a carpet edge with the tackless strip.

U.S. Pat. No. 6,371,446 issued Apr. 16, 2002 to Gauthier et al. for a Hand-Held Pneumatic Carpet Stretcher. The carpet stretcher of Gauthier et al. is powered by compressed air and includes a gripper plate which holds a front end of the carpet stretcher stationary behind a carpet tack strip, and teeth which pull the carpet towards the tack strip when pistons are pneumatically retracted.

SUMMARY OF THE INVENTION

In summary, the pneumatic carpet stretcher of the present invention includes a pneumatic actuator, a piston rod actuated by the pneumatic actuator driving a carpet gripping stretcher head towards an anchor pivotally mounted on a frame to the actuator and releasably mounted behind a tack strip on a floor to be carpeted so that the head and carpet is driven towards the anchor.

The piston rod extends from the actuator in a stroke direction from the actuator for forceful extension in the stroke direction upon actuation of the actuator. The stretcher head is mounted to a distal end of the piston rod, distal from the actuator. The stretcher head includes carpet engaging teeth protruding downwardly from the head and adapted to engage carpet when the head is brought into engagement with the carpet and the head is translated in the stroke direction as the piston rod is extended.

The frame may be a gripping bar supporting frame pivotally mounted to the actuator at a rearward end of the frame for pivotal motion of the frame relative to the actuator. The anchor may be a gripping bar mounted to an opposite forward end of the frame, opposite the rearward end. The gripping bar is sized to releasably mount between a tackless strip mounted to the floor and a wall adjacent the tackless strip and so as to engage the tackless strip. The head translates towards the gripping bar as the piston rod is extended from the actuator upon the actuation of the actuator. The pivotal motion raises or lowers the forward end of the frame relative to the actuator.

A resilient biasing means is mounted to the frame and to the actuator for resiliently biasing the frame so as to lower the forward end of the frame during the pivotal motion, and so that raising the forward end during the pivotal motion is against a return biasing force of the resilient biasing means. Advantageously, the return biasing force is sufficient to raise the actuator, the piston rod and the head relative to the gripping bar upon release of the actuator by the user so as to raise and disengage the head from the carpet.

Advantageously, the actuator is adapted for use as a handle to be held during use of the carpet stretcher by a user. A trigger for actuating the actuator may be mounted adjacent the actuator for one-handed application both of a downward force by the user on the actuator when holding the actuator so as to overcome the resilient biasing force and thereby to engage the head with the carpet, and simultaneous operation of the trigger to actuate the actuator to thereby drive the head and the carpet engaged by the head forcefully towards the gripping bar and the tackless strip.

In one embodiment, a frame mount is rigidly mounted to the actuator at a forward end of the actuator, and the frame is pivotally mounted to the frame mount. The resilient biasing means may be mounted between the frame and the frame mount. The frame mount may include a collar mounted on the forward end of the actuator so that the piston rod is journalled through the collar. A rigid bearing member may be mounted to the collar for bearing against the resilient biasing means.

The frame may include a longitudinally extending rigid elongate member. The resilient biasing means also bears against the elongate member. The elongate member may extend from the rigid bearing member towards the gripping bar.

A length adjustment means may be mounted on the elongate member for shortening the effective length of the elongate member between the bearing member and the gripping bar so as to elevate the gripping bar relative to the head, and for lengthening the effective length of the elongate member so as to lower the gripping bar relative to the head. In one preferred embodiment, the elongate member has a threaded-end adjacent the bearing member, and the length adjustment means is a threaded first stop member such as a threaded knob threadably mounted onto the threaded end for selective positioning along the threaded end. A second stop member may be mounted onto the threaded end for sandwiching the resilient biasing means between the second stop member and the bearing member. The resilient biasing means may be a spring bearing at one end against the second stop member and at an opposite end against the bearing member, and the bearing member may be sandwiched between the spring and the first stop member. In the preferred embodiment the second stop member is threaded and is threadably mounted on the threaded end for selective positioning along the threaded end. Further, the frame may also include at least one fork and advantageously a pair of forks extending from the frame mount to the gripping bar, extending along the elongate member.

The gripping bar may be pivotally mounted to the frame for rotation relative to the frame about a substantially vertical axis of rotation. The actuator may include an air cylinder sized for gripping as a handle for one-handed manipulation of the carpet stretcher. The trigger may be an elongate member, which actuates upwardly towards the actuator, mounted underneath the air cylinder for grasping by the fingers of the user when the user is gripping the actuator, and wherein the air cylinder is aligned substantially longitudinally relative to the frame. A selectively engageable latch may be provided for latching the trigger in an actuated position so as to provide for hands-free continued actuation of the actuator whereby the carpet may remain tensioned, once initially tensioned, without the user continuing to grasp the trigger.

A pole attachment may be provided which is mountable to the actuator for mounting a second carpet gripping head remote from the stretcher head. A stair attachment may also be provided, mountable to the actuator, which includes a vertical member extending substantially perpendicularly downwardly from the actuator to rest on a lower stair while an adjacent upper stair is having stretched carpet thereon. In one embodiment the stretcher head includes selectively retractable pins extendable so as to extend beneath the teeth and angled forwardly so as to aggressively grip and releasably mate with the carpet.

DETAILED DESCRIPTION OF EMBODIMENTS OF THE INVENTION

Figure 1:
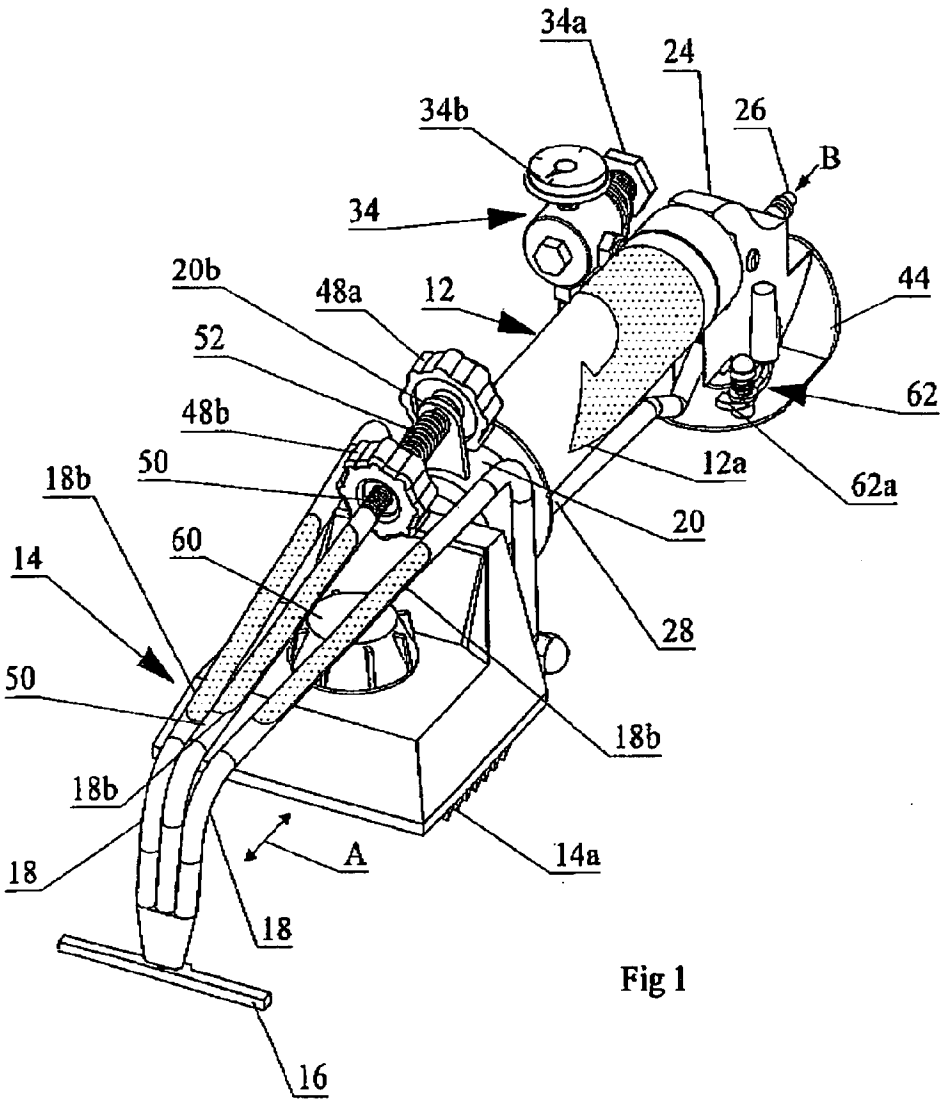
FIG. 1 is, in perspective view, the carpet stretcher according to one embodiment of the present invention.
Figure 2:
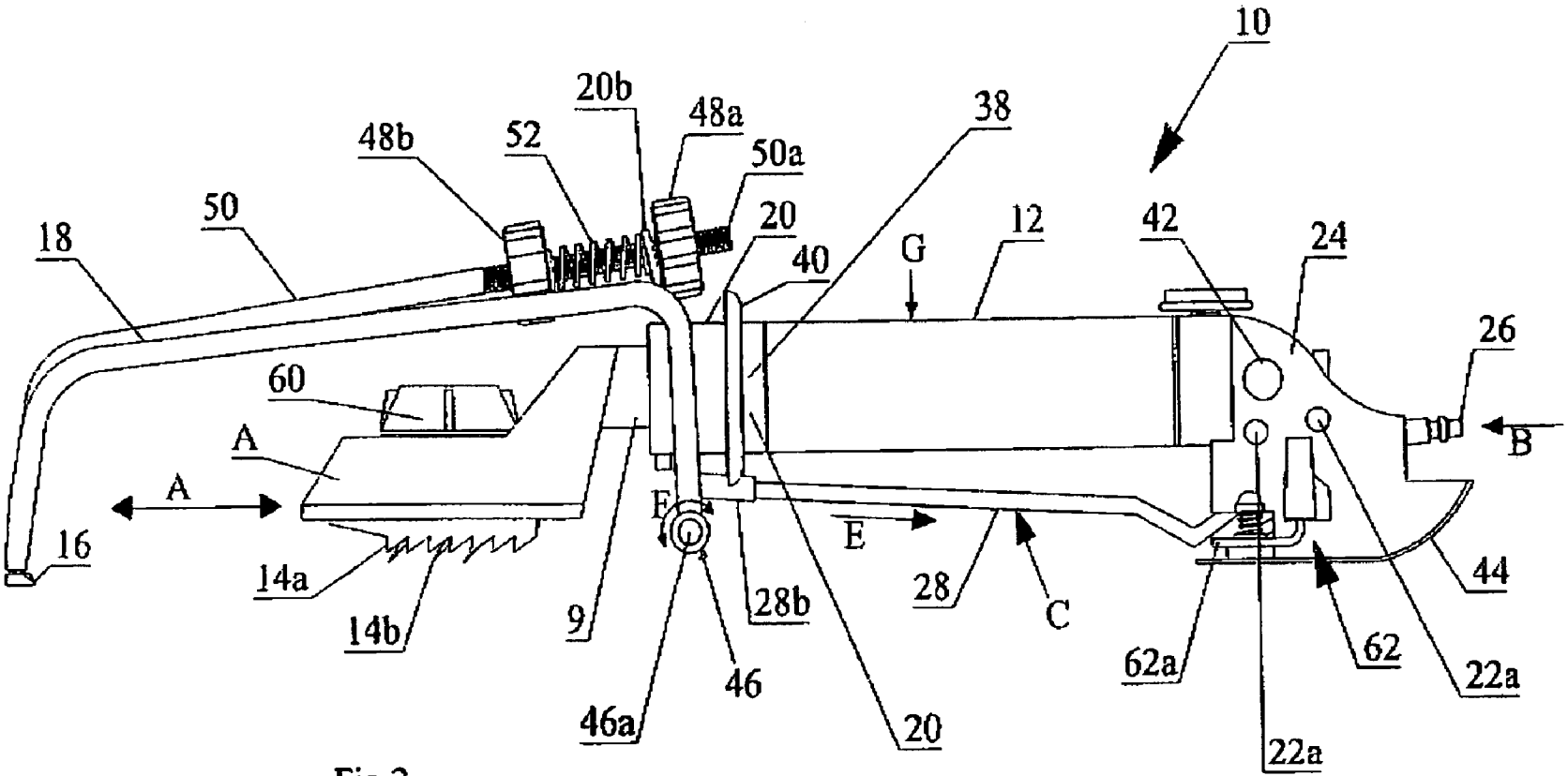
FIG. 2 is, in right side elevation view, the carpet stretcher of FIG. 1.
Figure 3:
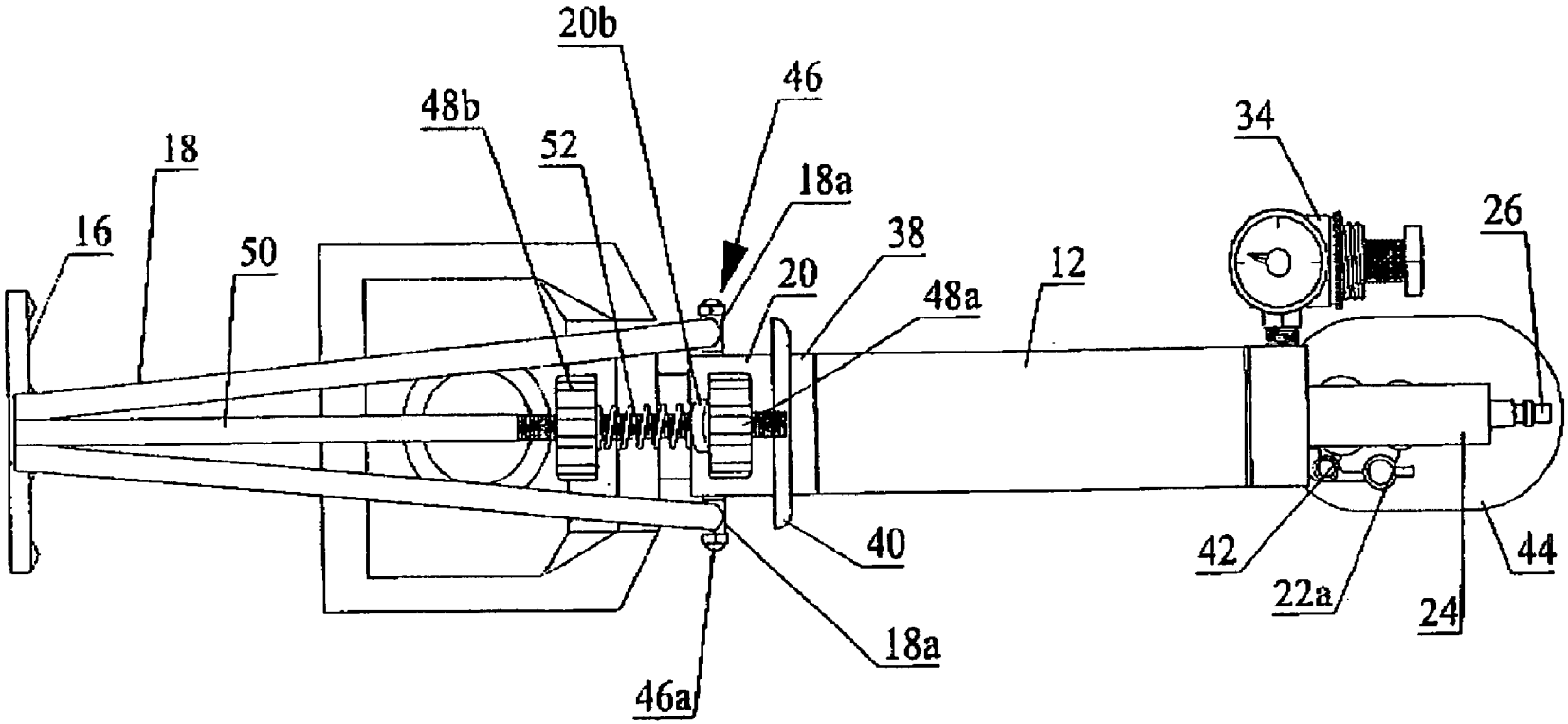
FIG. 3 is, in plan view, the carpet stretcher of FIG. 1.
Figure 4:
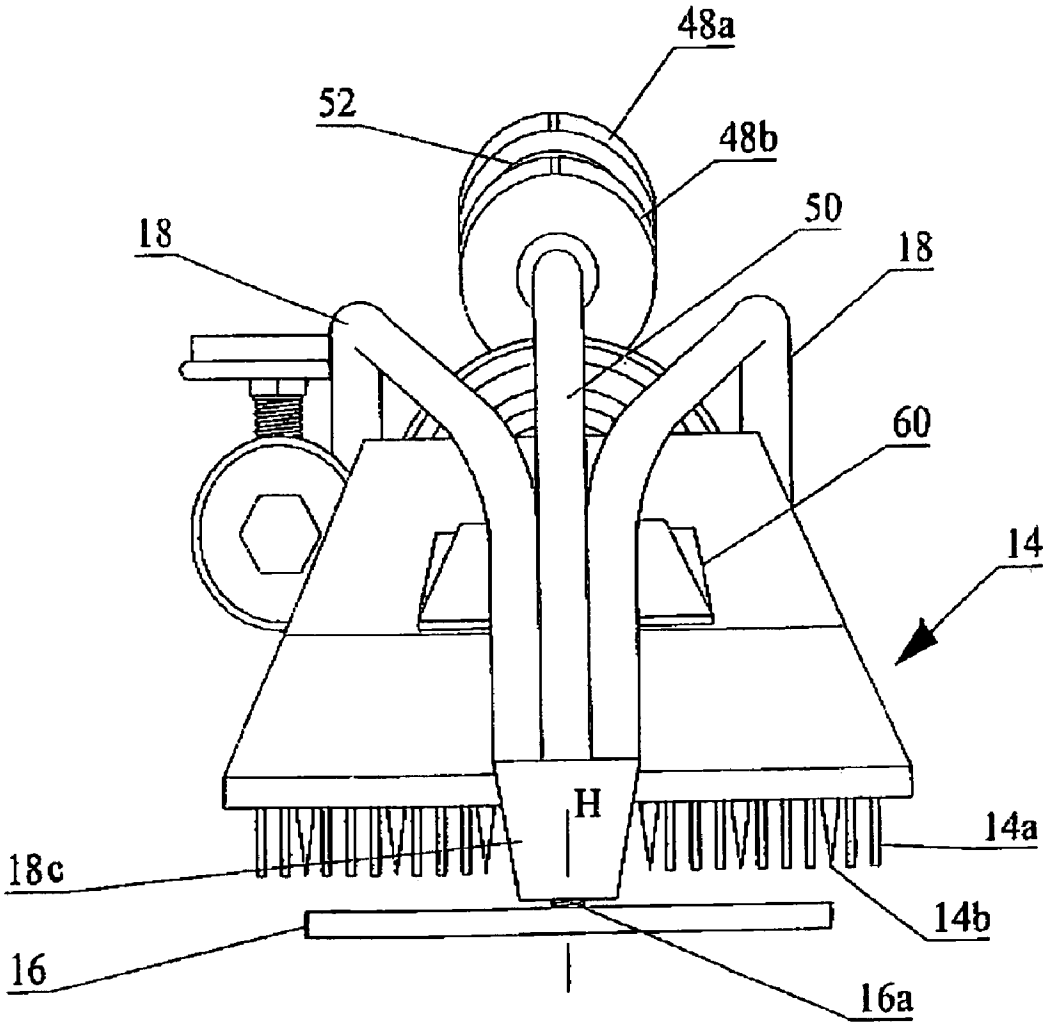
FIG. 4 is, in front elevation view, the carpet stretcher of FIG. 1.
Figure 5:
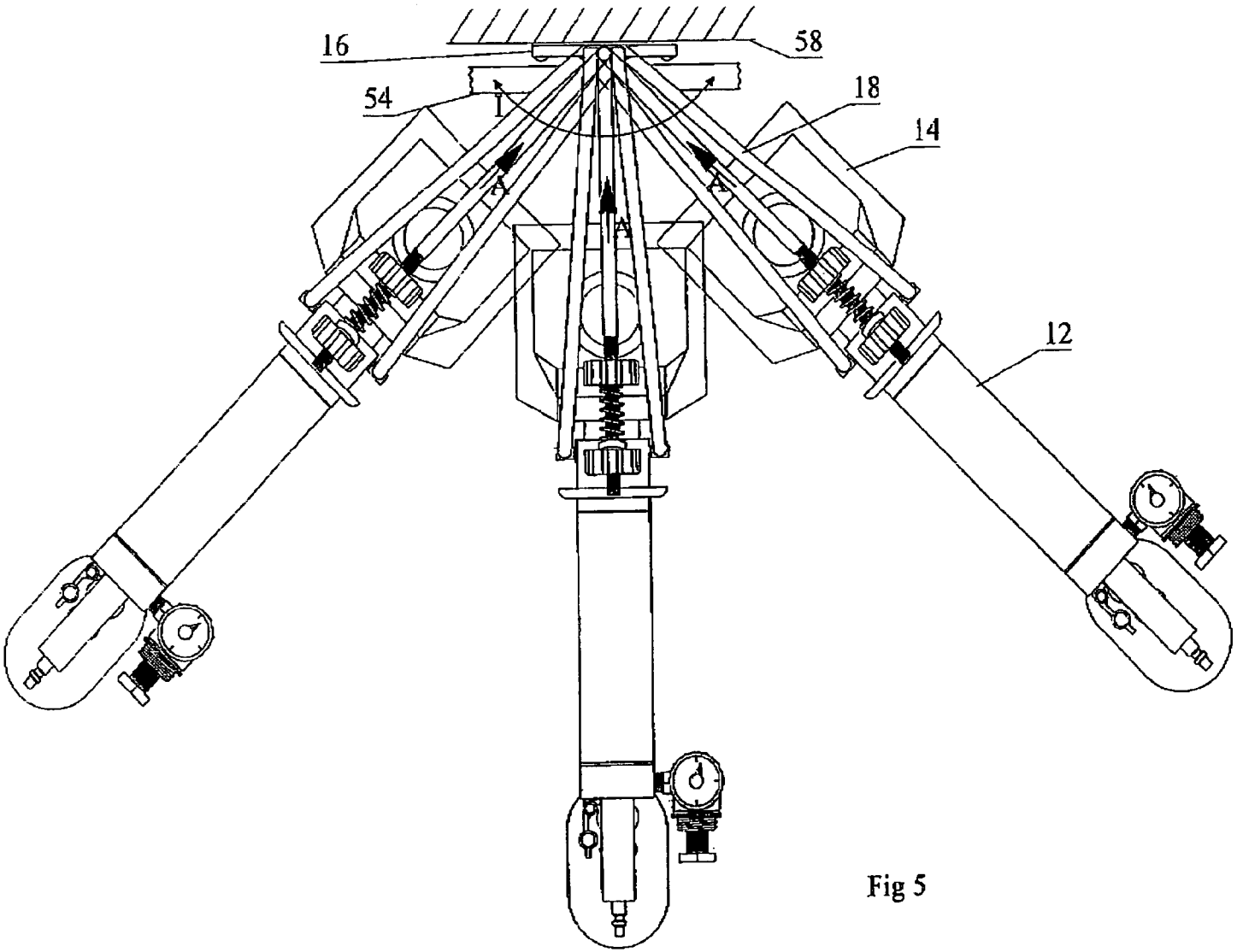
FIG. 5 is, in plan view, the carpet stretcher of FIG. 1 shown in operation being pivoted about the gripping bar.
Figure 6:
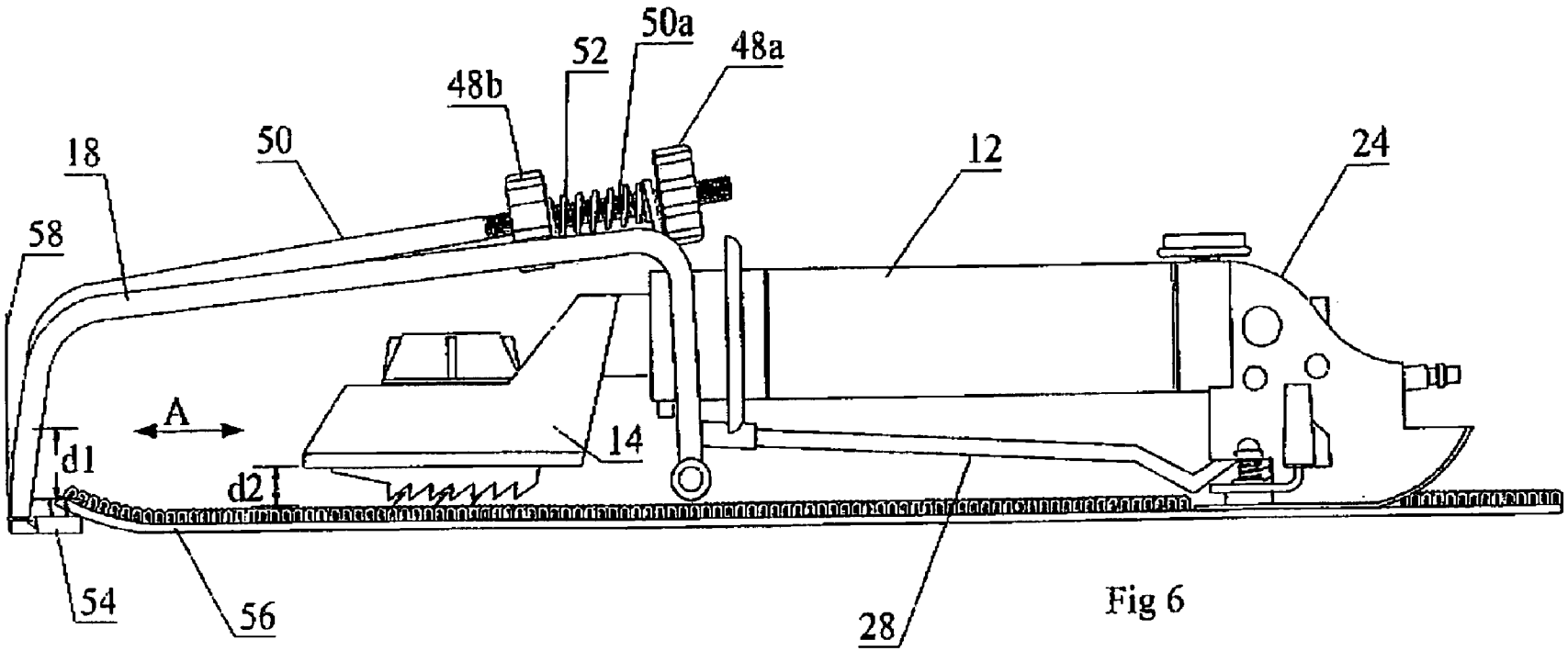
FIG. 6 is the side elevation view of FIG. 2 shown in operation before stretching of the carpet.
Figure 7:
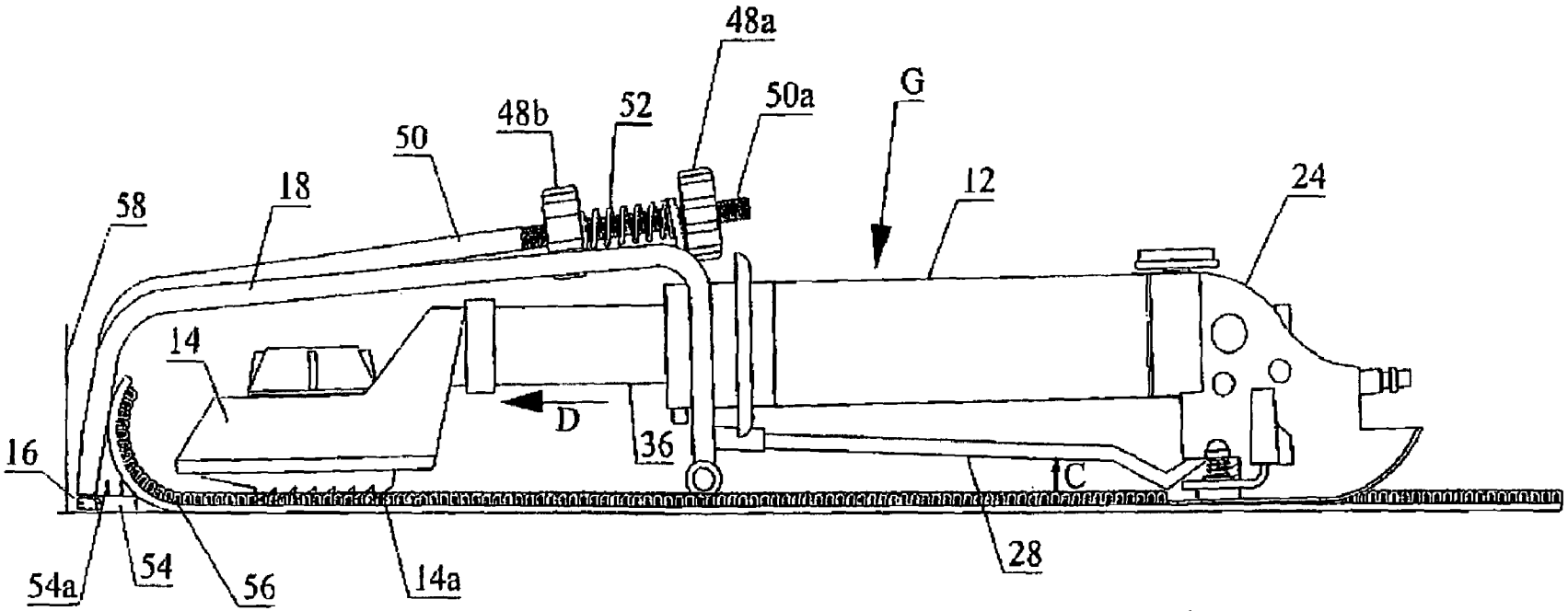
FIG. 7 is the side elevation view of FIG. 6 illustrating the carpet stretcher in operation following stretching of the carpet.
Figure 8:
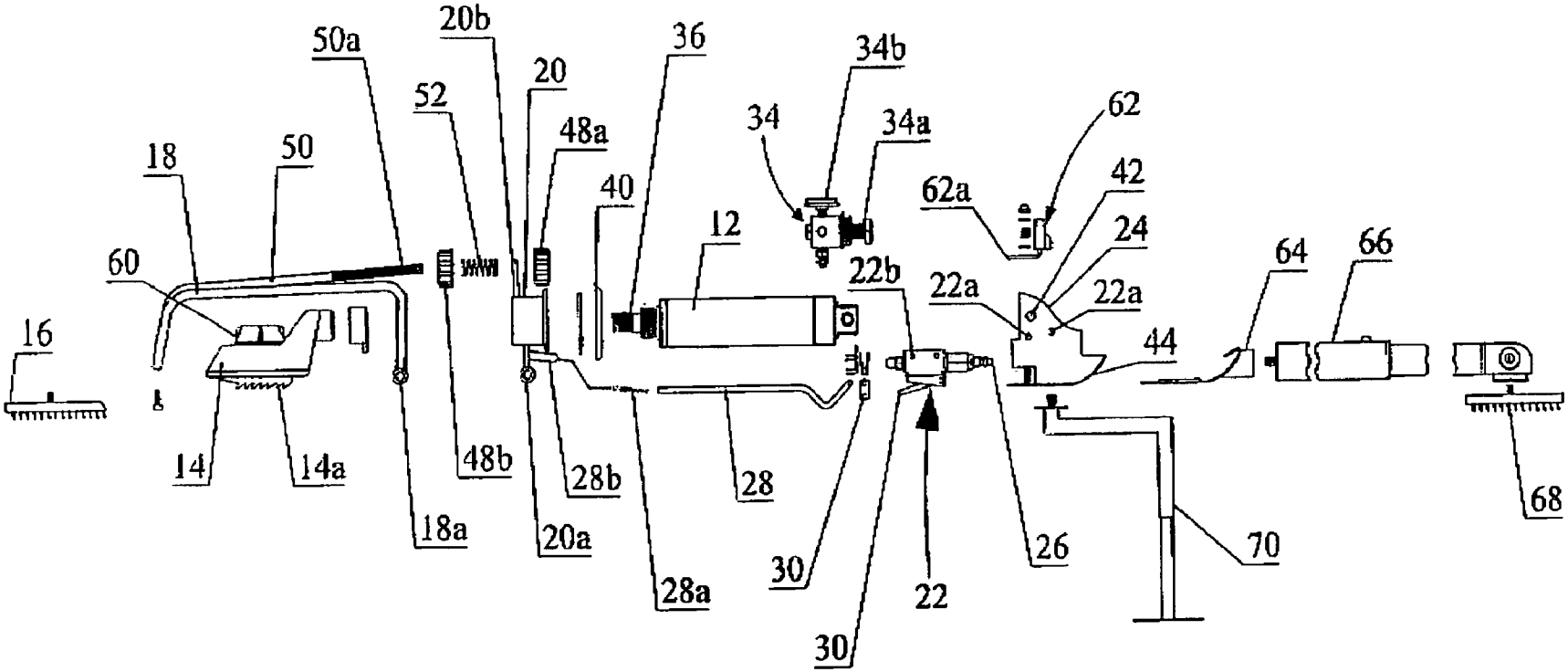
FIG. 8 is, in right side elevation partially exploded view, the carpet stretcher of FIG. 1, also illustrating two optional attachments for mounting to the heel block.
Figure 9:
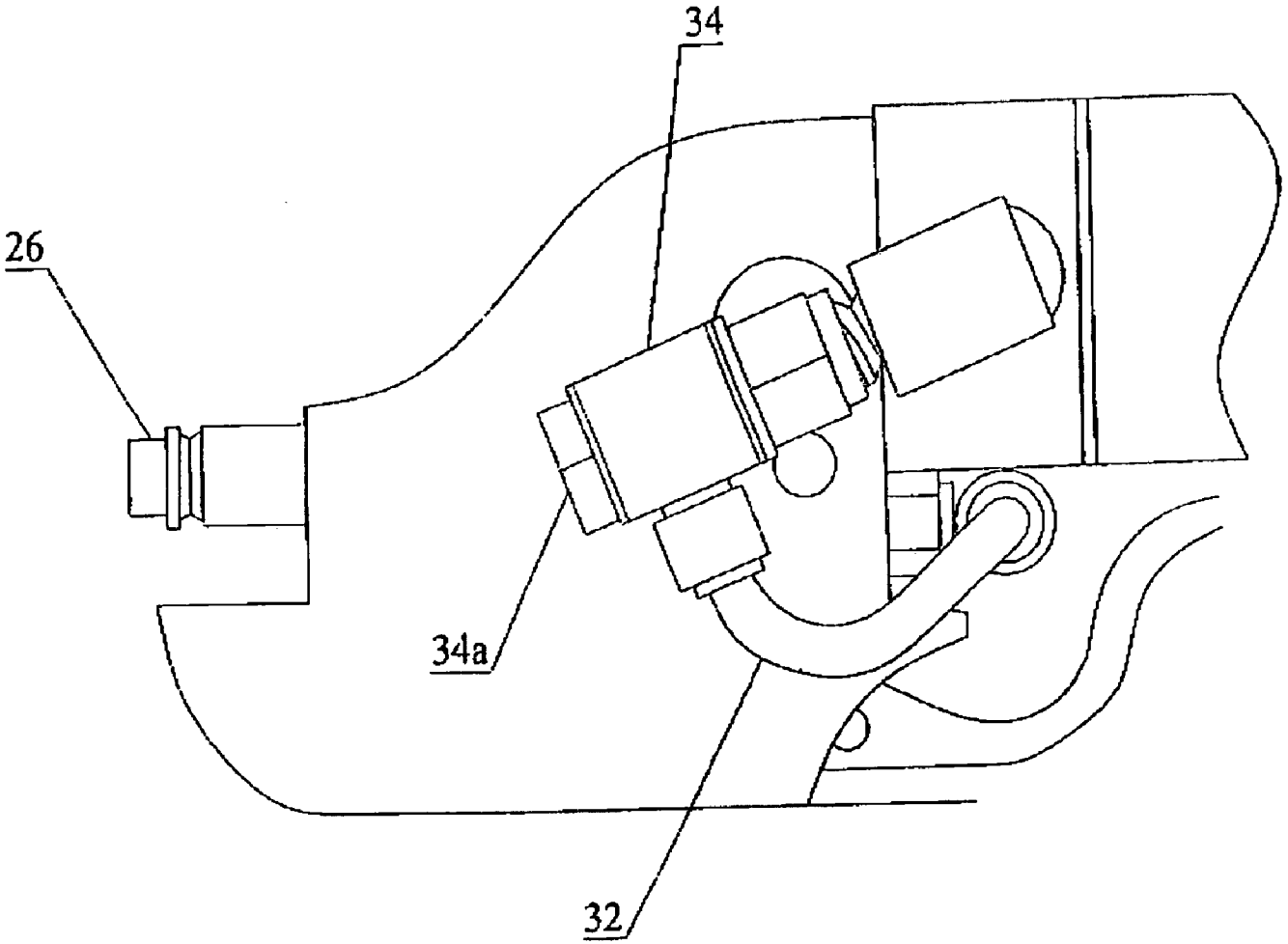
FIG. 9 is an enlarged partial left side elevation view illustrating one embodiment of an airflow control valve, with the pressure gauge removed, for use with the carpet stretcher according to the present invention.

As seen in the accompanying illustrations wherein like parts are denoted by corresponding reference numerals in each view, carpet stretcher 10 includes a pneumatically actuated air cylinder 12 having a non-slip surface 12*a* driving a carpet stretcher head 14 in direction A relative to a gripping bar 16 mounted on the distal end of forks 18 having a non-slip surface 18*b* pivotally mounted on yoke 20 between head 14 and air cylinder 12. In particular, compressed air, in one embodiment in the order of 125 psi, is fed from a compressor and air hose (not shown) to air actuator valve 22 mounted within heel block 24 via hose connector 26. Compressed air is delivered in direction B so as to flow through actuator valve 22 when air actuator trigger bar 28 is slid slightly forwardly and is elevated in direction C towards air cylinder 12 thereby biasing actuator valve 22 into its open position by means of actuating linkage 30. With actuator valve 22 in its open position, compressed air flows through the valve and, via conduit 32, through air flow control valve 34 which controls the air flow rate into air cylinder 12. Air flow regulator 34*a* on air flow control valve 34 may be adjusted to regulate the flow of air into air cylinder 12. An air pressure gauge 34*b* may be provided so that a user such as an installer knows the pressure of the air flow being delivered to air cylinder 12.

Upon actuation of trigger bar 28 so as to open actuator valve 22, air flows through control valve 34 into air cylinder 12 thereby driving an internal piston and piston rod 36 in direction D against the return biasing force of a helical coil spring (not shown) mounted within air cylinder 12 and acting against the translation of the piston in direction D. When the trigger bar is released, a spring 28*a* mounted in slide tube trigger bar mount 28*b* urges trigger bar 28 in direction E thereby lowering trigger bar 28 and linkage 30 to close valve 22, thereby shutting off air flow to air cylinder 12, and to vent the air pressure from air cylinder 12 thereby allowing head 14 and piston 36 to retract under the return biasing force of the helical spring within air cylinder 12.

Yoke 20 is mounted to the head-end of air cylinder 12 by means of mounting collar 38. Hand stop 40 is mounted to mount 38 to protect a user's hand. The heel-end of air cylinder 12 is mounted to heel block 24 by means of bolt 42. Actuator valve 22 is mounted through a longitudinally extending cavity in heel block 24 by means of bolts 22*a* journalled through corresponding apertures 22*b* in valve 22. A curved plate 44 is mounted under heel block 24 for ease of sliding the heel block over a carpeted surface.

Forks 18 are pivotally mounted to yoke 20 at fork mount 46 by means of shall 46*a* mounted through fork collars 18*a* and collar 20*a* or yoke 20. Thus forks 18 are free to pivot in direction F about shaft 46*a* so that the height of gripping bar 16 relative to teeth 14*a* on head 14 may be varied. In particular, the height of gripping bar 16 is adjusted by rotating treaded knob 48*a* along the threaded end 50*a* of height adjustment rod 50. The opposite gripping bar end of height adjustment rod 50 is co-terminous with the distal end of forks 18. Those ends are rigidly mounted to one another and have a threaded vertical bore 18*c* formed therein for receiving a threaded vertical shaft 16*a* protruding upwardly from gripping bar 16 so as to provide for rotation of gripping bar 16 about a generally vertical axis of rotation H through shaft 16a and the bore.

Threaded end 50*a* of height adjustment rod 50 is journalled through a hole in an upper flange 20*b*. Upper flange 20*b* is rigidly mounted to yoke 20 so as to protrude upwardly therefrom. A second knob 48*b* is also threadably mounted onto threaded end 50*a* of height adjustment rod 50, between the gripping bar end and upper flange 20*b*, so as to sandwich a helical coil spring 52 between knobs 48*a* and 48*b*. Upper flange 20*b* is sandwiched between spring 52 and knob 48*a*. Because threaded end 50*a* is free to slide through the hole in upper flange 20*b*, spring 52 provides for resilient tensioning of knob 48*a* against flange 20*b* thereby urging forks 18 and gripping bar 16 downwardly about shaft 46*a*. This acts to raise head 14. In us head 14 is pushed down to engage the carpet. During use forks 18 and gripping bar 16 may be thus slightly elevated relative to head 14 against the return biasing force of spring 52.

In operation, with a user gripping air cylinder 12 with one hand (that is, cylinder 12 being the handle) and with gripping bar 16 mounted behind tackless strip 54, the user may press downwardly on cylinder 12 in direction G thereby resiliently deflecting head 14 and teeth 14*a* into gripping contact with carpet 56 so that, with head 14 thus engaged down into carpet 56, trigger bar 28 may be grasped and pulled slightly forwardly and upwardly in direction C to thereby actuate piston rod 36 in direction D driving head 14 and carpet 56 towards gripping bar 16 and tackless strip 54. Depending on the type and thickness of carpet 56, head 14 may be provided with retractable pins 14*b* which may be extended downwardly from, or retracted upward into head 14 by the operation of knob 60. Once carpet 56 has been sufficiently tensioned towards tackless strip 54, the carpet may be pressed downwardly to mate the underside of carpet 56 with the upwardly projecting pins 54*a* of tackless strip 54 thereby anchoring the carpet adjacent wall 58. The fork depth adjustment distance d1 is adjustable by the positioning of knob 48*b* along threaded end 50*a*. The stretcher head 14 height disengagement adjustment d2 is adjustable by the positioning of knob 48*a* along threaded end 50*a*.

Rotation of gripping bar 16 about axis of rotation H, when gripping bar 16 is mounted behind tackless strip 54, provides for rotation of forks 18, head 14 and air cylinder 12 in direction 1 so that the driving of head 14 in direction A may be angularly varied relative to gripping bar 16, and therefore relative to tackless strip 54 and wall 58 for example by fifteen degrees either side of perpendicular to wall.

A rotatable latch 62 may be mounted to one side of heel block 24 so that a latch arm 62*a* may be rotated about a vertical axis of rotation underneath trigger bar 28 so as to releasably hold trigger bar 28 in the "on" or upwardly engaged position to keep air pressure acting on piston 36 without the need for a user to continue to pull upwardly on the trigger bar.

The carpet stretcher 10 works as follows: With excess carpet running up the wall, pull that carpet back slightly to expose the gully area along the floor between the wall and the tackless strip. A three inch long by three eightbs of an inch wide metal plate which may serve as the gripping bar 16 on the nose or distal end 18*c* of the forks is attached into the carpet gully. While placing a little downward hand pressure on the middle of the handle (the air cylinder), the user squeezes and slightly pulls forward a lower handle (the trigger bar) which release air pressure to the air cylinder to drive the head. The head ten slowly moves forward toward the wall, gripping the carpet arid stretching, moving, and pulling the carpet along with the head. The user is now able to tuck the carpet into the gully. By setting the "trigger lock" latch 62 in place, the user is free to take extra time or as much time as necessary because pressure is maintained on the head and carpet. The process is repeated by lifting or sliding-over and setting the approximately seven pound carpet stretcher 10 every twelve to fourteen inches along the perimeter of the carpet at a fifteen degree angle as per CRI104/105 Installation Standard Stretch Diagram.

An attachment may be provided such as coupler 64 and pole 66 for mating onto slide plate 44 so as to extend pole 66 collinearly and oppositely to piston 36. A second carpet gripping head 68 when mounted on the distal end of pole 66, may thus engage carpet 56 remotely from head 14 so that, the driving of head 14 and piston 36 in direction D, tensions carpet 56 against where head 68 is mounted to the carpet. In addition, a stair attachment may be provided. Stair attachment 70 is a perpendicular extension which screws into the heel block skid plate. The attachment rests on the lower tread or main floor leading to the staircase, and extends up and parallel with the riser of the stair to be stretched. The main body of the air cylinder will be parallel to the adjoining upper tread.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A carpet stretcher comprising:

a pneumatic actuator, a piston rod extending from said actuator in a stroke direction from said actuator for extension in said stroke direction upon actuation of said actuator, a stretcher bead mounted to a distal end of said piston rod, distal from said actuator, said stretcher bead having carpet engaging teeth protruding downwardly from said head and adapted to engage carpet when said bead is brought into engagement with the carpet and said head is translated in said stroke direction as said piston rod is extended, a gripping bar supporting frame pivotally mounted to said actuator at a rearward end of said frame for pivotal motion of said frame relative to said actuator, a gripping bar mounted to an opposite forward end of said frame, opposite said rearward end, said gripping bar sized to releasably mount between a tackless strip mounted to a floor and a wall adjacent the tackless strip and so as to engage the tackless strip, said head translating towards said gripping bar as said piston rod is extended from said actuator upon said actuation of said actuator, said pivotal motion raising or lowering said forward end of said frame relative to said actuator, wherein said actuator is adapted for use as a handle to be held during use of said carpet stretcher by a user, a resilient biasing means mounted to said frame and to said actuator for resiliently biasing said frame so as to lower said forward end during said pivotal motion, and so that raising said forward end during said pivotal motion is against a return biasing force of said resilient biasing means, and wherein said return biasing force is sufficient to raise said actuator, said piston rod and said head relative to said gripping bar upon release of said actuator by the user so as to raise and disengage said head from the carpet when said gripping bar is in said engagement with the tackless strip and said carpet stretcher is being used to stretch a carpet to engage an edge of the carpet onto the tackless strip, and wherein a trigger for actuating said actuator is mounted adjacent said actuator for one-handed application both of a downward force by the user on said actuator when holding said actuator so as to overcome said resilient biasing force and thereby to engage said head with the carpet, and simultaneous operation of said trigger to actuate said actuator to thereby drive said head and the carpet engaged by said head towards said gripping bar and the tackless strip.

2. The device of claim 1 further comprising a frame mount rigidly mounted to said actuator at a forward end of said actuator, said frame pivotally mounted to said frame mount.

3. The device of claim 2 wherein said resilient biasing means is mounted between said frame and said frame mount.

4. The device of claim 3 wherein said frame mount includes a collar mounted on said forward end of said actuator so that said piston rod is journalled through said collar, and a rigid bearing member mounted to said collar for bearing against said resilient biasing means.

5. The device of claim 4 wherein said frame includes a longitudinally extending rigid elongate member, and wherein said resilient biasing means also bears against said elongate member, and wherein said elongate member extends from said rigid bearing member towards said gripping bar.

6. The device of claim 5 further including a length adjustment means mounted on said elongate member for shortening a length of said elongate member between said bearing member and said gripping bar so as to elevate said gripping bar relative to said head, and for lengthening said length of said elongate member so as to lower said gripping bar relative to said head.

7. The device of claim 6 wherein said elongate member has a threaded-end adjacent said bearing member, and wherein said length adjustment means is a threaded first stop member threadably mounted onto said treaded end for selective positioning along said threaded end.

8. The device of claim 7 further comprising a second stop member mounted onto said threaded end for sandwiching said resilient biasing means between said second stop member and said bearing member.

9. The device of claim 8 wherein said resilient biasing means is a spring bearing at one end against said second stop member and at an opposite end against said bearing member, and wherein said bearing member is sandwiched between said spring and said first stop member.

10. The device of claim 9 wherein said second stop member is threaded and threadably mounted on said threaded end for selective positioning along said threaded end.

11. The device of claim 5 wherein said frame also includes at least one fork extending from said frame mount to said gripping bar.

12. The device of claim 11 wherein said at least one fork includes a pair of forks mounted so as to extend along opposite sides of said elongate member.

13. The device of claim 11 wherein said gripping bar is pivotally mounted to said frame for rotation relative to said frame about a substantially vertical axis of rotation.

14. The device of claim 1 wherein said actuator includes an air cylinder sized for gripping as a handle for one-banded manipulation of said carpet stretcher.

15. The device of claim 14 wherein said trigger is an elongate member mounted underneath said air cylinder for grasping by the fingers of the user when the user is gripping said actuator, and wherein said air cylinder is aligned substantially longitudinally relative to said frame.

16. The device of claim 15 wherein said trigger actuates upwardly towards said actuator.

17. The device of claim 16 further comprising a selectively engageable latch for latching said trigger in an actuated position so as to provide for bands-free continued actuation of said actuator whereby the carpet may remain tensioned, once initially tensioned, without the user continuing to grasp said trigger.

18. The device of claim 1 further comprising a pole attachment mountable to said actuator for mounting a second carpet gripping head remote from said stretcher head.

19. The device of claim 1 further comprising a stair attachment mountable to said actuator, said stair attachment comprising a vertical member extending substantially perpendicularly downwardly from said actuator to rest on a lower stair while an adjacent upper stair is having carpet thereon stretched.

20. The device of claim 1 wherein said gripping bar is pivotally mounted to said frame for rotation relative to said frame about a substantially vertical axis of rotation, and wherein said forward end of said frame is formed as a nose to provide for said rotation without interference with the wall adjacent the tackless strip.

* * * * *

UNITED STATES PATENT AND TRADEMARK OFFICE

CERTIFICATE OF CORRECTION

PATENT NO. : 7,159,850 B2
APPLICATION NO. : 11/169640
DATED : January 9, 2007
INVENTOR(S) : Lee Peters It is certified that error appears in the above-identified patent and that said Letters Patent is hereby corrected as shown below:

Column 7, line 17
replace “bead” with --head--
Column 7, line 18
replace “bead” with --head--
Column 7, line 20
replace “bead” with --head--

Signed and Sealed this

Thirty-first Day of July, 2007

JON W. DUDAS
*Director of the United States Patent and Trademark Office*